US010184709B2

(12) United States Patent
Yang

(10) Patent No.: US 10,184,709 B2
(45) Date of Patent: Jan. 22, 2019

(54) ICE TRAY APPARATUS AND METHOD

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 485 days.

(21) Appl. No.: 14/835,601

(22) Filed: Aug. 25, 2015

(65) Prior Publication Data

US 2016/0370068 A1 Dec. 22, 2016

(30) Foreign Application Priority Data

Jun. 17, 2015 (KR) ..... 10-2015-0086166

(51) Int. Cl.
*F25C 1/24* (2018.01)

(52) U.S. Cl.
CPC ..... *F25C 1/24* (2013.01); *F25C 2400/14* (2013.01); *F25C 2500/02* (2013.01)

(58) Field of Classification Search
CPC .... F25C 1/04; F25C 1/045; F25C 1/06; F25C 1/22; F25C 1/225; F25C 1/24–1/246; F25C 5/005; F25C 5/182; F25C 5/185
USPC ..... 249/119, 129, 130, 141
See application file for complete search history.

(56) References Cited

U.S. PATENT DOCUMENTS

| | | | | |
|---|---|---|---|---|
| 9,080,799 | B2 * | 7/2015 | Hong | F25C 1/00 |
| 2007/0170345 | A1 * | 7/2007 | Tsujimoto | F25C 1/243 249/114.1 |
| 2014/0130537 | A1 | 5/2014 | Gu et al. | |
| 2016/0201965 | A1 * | 7/2016 | Abeygunawardana | F25C 5/08 62/349 |

FOREIGN PATENT DOCUMENTS

| | | | | |
|---|---|---|---|---|
| JP | H07-305930 | A | 11/1995 | |
| JP | 2003-279210 | | 10/2003 | |
| JP | 2007-101000 | A | 4/2007 | |
| KR | 10-2014-0059938 | A | 5/2014 | |
| WO | WO 2011155801 | A2 * | 12/2011 | F25C 1/24 |
| WO | WO 2015056977 | A1 * | 4/2015 | F25C 1/24 |

* cited by examiner

*Primary Examiner* — Jianying Atkisson
*Assistant Examiner* — Antonio R Febles

(57) ABSTRACT

The present disclosure describes ice tray devices and methods. In one embodiment, ice tray is included in an ice-making device of a refrigerator. The ice tray can be configured to uniformly distribute water to a plurality of ice-making spaces included in the ice tray. The ice tray can include water supply grooves that provide paths through which water is allowed to flow in the tray body. The dimensions of the water supply grooves can vary enabling control of water and ice formation depth of the water supply grooves can become gradually larger from one end portion of the tray body toward the other end portion of the tray body.

19 Claims, 7 Drawing Sheets

ICE TRAY APPARATUS AND METHOD

RELATED APPLICATION

This application is based on and claims priority to Korean Patent Application No. 10-2015-0086166, filed on Jun. 17, 2015, the disclosure of which is incorporated herein in its entirety by reference.

FIELD

The present disclosure relates to an ice tray for an ice-making device of a refrigerator.

BACKGROUND

A refrigerator is an apparatus for storing food at a relatively low temperature and may be configured to store food in a frozen state or a refrigerated state. A decision to store food in a frozen state or refrigerated state may depend on the kind of food to be stored.

The interior of the refrigerator is cooled by supplied cold air, in which the cold air is typically generated by a temperature exchange action of a refrigerant according to a cooling cycle including compression, condensation, expansion and evaporation. The cold air supplied to the inside of the refrigerator can be distributed in the refrigerator by convection. Thus, items within the refrigerator can be stored at a desired temperature.

A refrigerator typically includes a main body having a rectangular parallelepiped shape with an open front side. A refrigerating compartment (e.g.; refrigerating space, portion, room, etc.) and a freezing compartment (e.g.: freezing space, portion, room, etc.) may be provided within the main body. A refrigerating compartment door and a freezing compartment door for selectively closing and opening the refrigerator compartment and the freezing compartment may be provided on the front side or surface of the main body. A plurality of drawers, shelves and container boxes for storing different kinds of food in a desired state may be provided in the internal storage spaces of the refrigerating compartment and freezing compartment.

Conventionally, mainstream refrigerators are top-mount-type refrigerators having a freezing compartment positioned at an upper side or portion of the refrigerator and a refrigerating compartment positioned at the lower side or portion of the refrigerator. There are also commercially available bottom-freeze-type refrigerators. Bottom-freeze-type refrigerators can enhance user convenience in which a more frequently-used refrigerating compartment is positioned at an upper portion of the refrigerator and a less frequently used freezing compartment is positioned at a lower portion of the refrigerator. This provides an advantage in that a user can conveniently use the refrigerating compartment. However, the bottom-freeze-type refrigerators (in which the freezing compartment is positioned at the lower portion or side) can pose an inconvenience when a user does access the freezing compartment, in that a user typically has to bend at the waist to open the freezing compartment door (e.g., to take out pieces of ice, food, etc.).

Traditional attempts at solving the above problem in the bottom freeze type refrigerators have included an ice dispenser installed in the refrigerating compartment or refrigerating compartment door in some implementations. In this approach, the refrigerating compartment door or the inside of the refrigerating compartment may be provided with an ice maker which generates ice.

The ice-making device may include an ice-making assembly provided with an ice tray for producing pieces of ice (e.g., in various shapes including cubes, cylindrical, semi-spherical, etc.), an ice bucket which stores the pieces of ice, and a feeder assembly which feeds the pieces of ice stored in the ice bucket to the dispenser.

Conventional ice trays attempt to retain water in a plurality of ice-making spaces. The ice-making spaces are formed on the upper surface of a tray body. A water supply port capable of distributing water to the ice-making spaces is formed on one surface of the tray body. Water distribution grooves are formed between the ice-making spaces. Thus, the ice-making spaces are connected to one another in an attempt to allow water to flow between the ice-making spaces. However, traditional ice trays often do not adequately supply water to each of the ice making spaces.

Since the main body of the conventional refrigerator is often inclined at an angle with respect to the floor surface, traditional ice trays in the refrigerator are also typically inclined at a similar angle. Thus, water in the ice-making spaces of the ice tray cannot smoothly move through the water supply grooves of the ice tray. This poses a problem in that the amount of water supplied to the ice-making spaces of the ice tray is not uniform.

Furthermore, if the amount of water supplied to the ice tray is not uniform, there is a problem in that the size of the ice pieces produced in the ice tray becomes non-uniform. As a result, ice pieces may not be produced in some of the ice-making spaces. The size of ice pieces produced in some of the ice-making spaces may be too small. Furthermore, in conventional approaches where a temperature sensor for detecting generation of ice pieces is provided on one surface of the ice tray, there is a problem in that the temperature sensor may not accurately detect generation of ice pieces.

SUMMARY

The present disclosure describes ice tray devices and methods. In one embodiment, ice tray is included in an ice-making device of a refrigerator. In one exemplary implementation, the ice tray is configured to uniformly distribute water to a plurality of ice-making spaces included in the ice tray.

In one embodiment, an ice tray comprises: a tray body configured to provide ice-making spaces for retaining water; and a plurality of partition walls. The plurality of partition walls include: a first sidewall, a second sidewall and a threshold. The first side wall extends by a predetermined length from one side surface of the tray body toward each of the ice-making spaces. The second sidewall extends by a predetermined length from the other side surface of the tray body toward each of the ice-making spaces, the second sidewall spaced apart from the first sidewall by a predetermined distance. The threshold extends upward from a bottom surface of the tray body to interconnect a lower portion of the first sidewall and a lower portion of the second sidewall. The length of the thresholds extends upward from the bottom surface of the tray body gradually decreases from one end portion of the tray body toward the other end portion of the tray body.

The length of the first sidewalls extending from one side surface of the tray body may gradually increase from one end portion of the tray body toward the other end portion of the tray body. The length of the second sidewalls extending from the other side surface of the tray body may gradually increase from one end portion of the tray body toward the other end portion of the tray body. The first sidewalls, the second sidewalls and the thresholds can define a plurality of water supply grooves which allow water to flow between the ice-making spaces. The depth of the water supply grooves may grow larger from one end portion of the tray body toward the other end portion of the tray body.

The width of the water supply grooves can grow smaller from one end portion of the tray body toward the other end portion of the tray body, and the water supply grooves are disposed along a longitudinal direction of the tray body so as to have a substantially equal cross-sectional area. A reference line through upper end portions of the thresholds extending upward from the bottom surface of the tray body can form a second angle with respect to the bottom surface of the tray body.

In one embodiment, a refrigerator comprises: a main body configured to constitute an outer shell and obliquely installed at a first angle with respect to a floor surface so that the other end portion of the main body is disposed higher than one end portion of the main body; and an ice-making device configured to produce ice pieces. The ice-making device include an ice tray configured to include ice-making spaces capable of retaining water and phase-transformed into ice pieces. The ice tray includes: a tray body configured to provide ice-making spaces for retaining water; and a plurality of partition walls. The plurality of partition walls include: a first sidewall extending by a predetermined length from one side surface of the tray body toward each of the ice-making spaces; a second sidewall extending by a predetermined length from the other side surface of the tray body toward each of the ice-making spaces, the second sidewall spaced apart from the first sidewall by a predetermined distance; and a threshold extending upward from a bottom surface of the tray body to interconnect a lower portion of the first sidewall and a lower portion of the second sidewall, wherein the length of the thresholds extending upward from the bottom surface of the tray body gradually decreases from one end portion of the tray body toward the other end portion of the tray body.

In one embodiment, a method of manufacturing an ice tray comprises: injection-molding a molding material into a tray body of an ice tray which includes a plurality of ice-making spaces; and forming water supply grooves that provide paths through which water is allowed to flow in the tray body, so that the depth of the water supply grooves becomes gradually larger from one end portion of the tray body toward the other end portion of the tray body. The water supply grooves are formed so that the width of the water supply grooves grows smaller from one end portion of the tray body toward the other end portion of the tray body. The water supply grooves are disposed along a longitudinal direction of the tray body so as to have a substantially equal cross-sectional area.

Forming the water supply grooves can include forming a plurality of partition walls. The plurality of partition walls include: a first sidewall, a second sidewall and a threshold. The first side wall extends by a predetermined length from one side surface of the tray body toward each of the ice-making spaces. The second sidewall extends by a predetermined length from the other side surface of the tray body toward each of the ice-making spaces, the second sidewall spaced apart from the first sidewall by a predetermined distance. The threshold extends upward from a bottom surface of the tray body to interconnect a lower portion of the first sidewall and a lower portion of the second sidewall. The length of the thresholds extends upward from the bottom surface of the tray body gradually decreases from one end portion of the tray body toward the other end portion of the tray body. The tray body can be configured to include ice-making spaces for retaining water.

DETAILED DESCRIPTION

Figure 1:
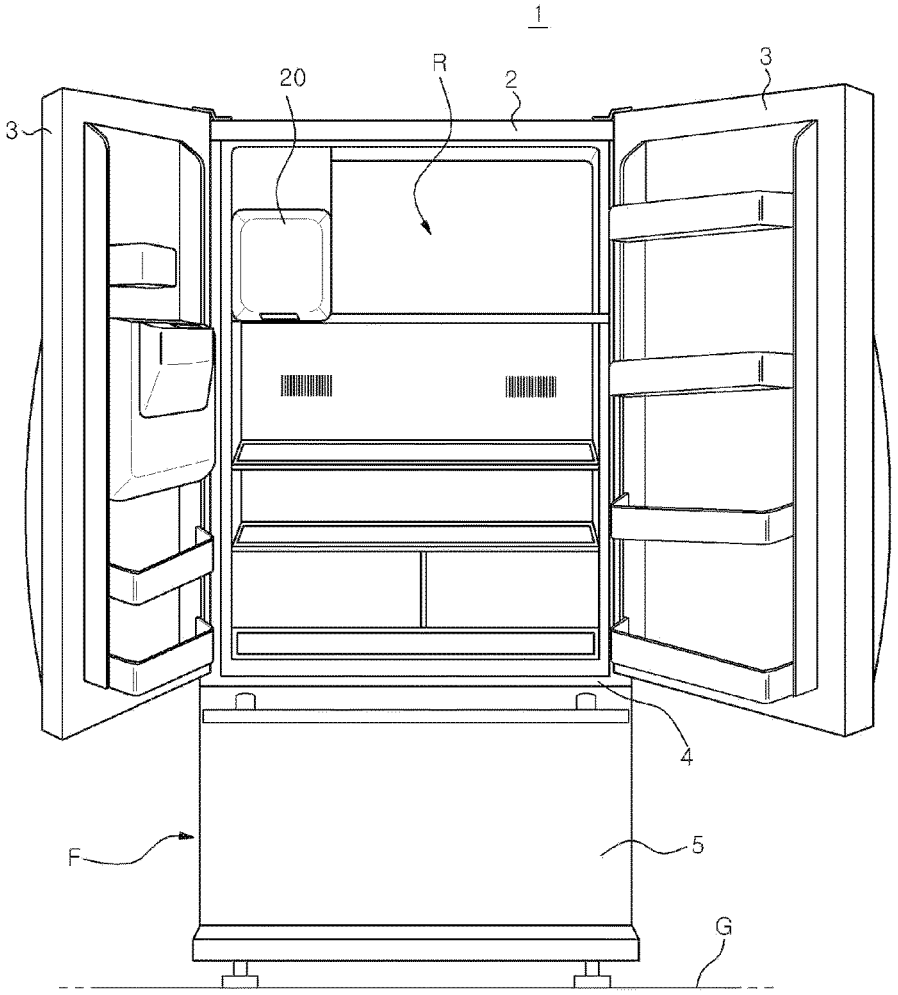
FIG. 1 is a front view of a refrigerator including an ice tray of an ice-making device according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily understood by those skilled in the art. As those skilled in the art will realize, the described exemplary embodiments may be modified in various different ways without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
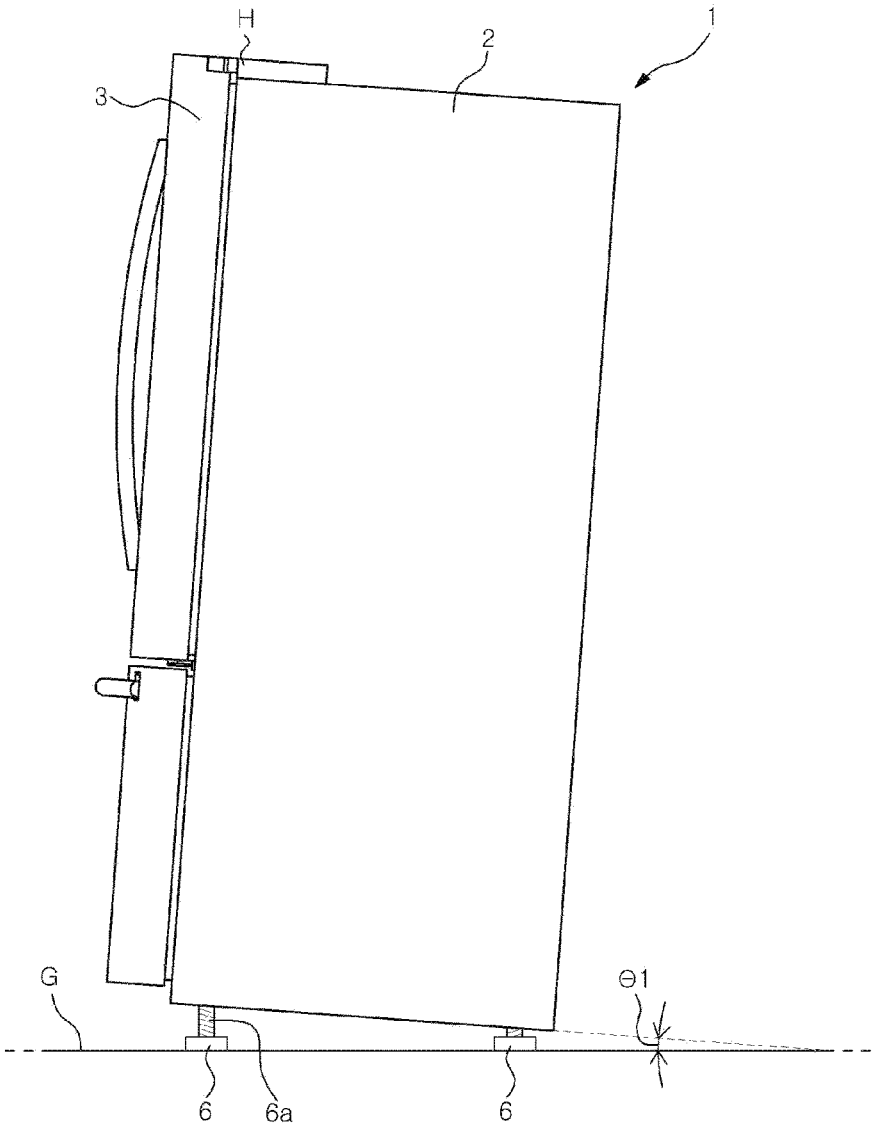
FIG. 2 is a side view illustrating a state in which the refrigerator illustrated in FIG. 1 is obliquely installed with respect to a floor surface with the refrigerator doors capable of self closing.

FIG. 1 is a front view of a refrigerator including an ice tray of an ice-making device according to one aspect of the present disclosure, and FIG. 2 is a side view illustrating a state in which the refrigerator illustrated in FIG. 1 is obliquely installed with respect to a floor surface with the doors kept closed.

Referring to FIGS. 1 and 2, the refrigerator 1 according to the present embodiment may include a main body 2 which constitutes an outer shell, a barrier 4 which divides food storage spaces (e.g., compartments, portions, rooms, etc.) formed within the main body 2. One food storage space includes an upper refrigerating compartment R and another food storage space includes a lower freezing compartment F. Refrigerating compartment doors 3 are provided on the opposite edges of the front surface of the main body 2 and configured to selectively open and close the refrigerating compartment R by the rotational movement of the refrigerating space doors 3. Freezing compartment door 5 is configured to open and close the front opening portion of the freezing compartment F by the movement of the freezing compartment door 5. In the one example implementation, an ice-making device 20 is provided in a region on one side of the upper portion of the refrigerating compartment R. The ice-making device 20 may be installed in other positions of the refrigerating compartment R or in one of the refrigerating compartment doors 3.

The main body 2 may be installed on a floor surface G through adjustable legs 6. The adjustable legs 6 are provided in a plural number on the bottom surface of the main body 2 and may support the main body 2 in the positions between the floor surface G and the main body 2. Each of the adjustable legs 6 may include a height adjusting screw 6*a*. The height of the main body 2 from the floor surface G may be adjusted by tightening or loosening the height adjusting screw 6*a*. As illustrated in FIG. 2, the main body 2 may be lifted up by the adjustable legs 6 so that the front end portion of the main body 2 is positioned higher than the rear end portion thereof. As a result, the main body 2 is inclined at a predetermined angle (hereinafter referred to as a "first angle θ1") from the front end portion of the main body 2 toward the rear end portion thereof. In one embodiment, even if a user does not push the refrigerating room doors 3 closed after opening them, the refrigerating room doors 3 are rotated backward about hinges H and are automatically closed. This enables a user to conveniently use the refrigerator.

Figure 3:
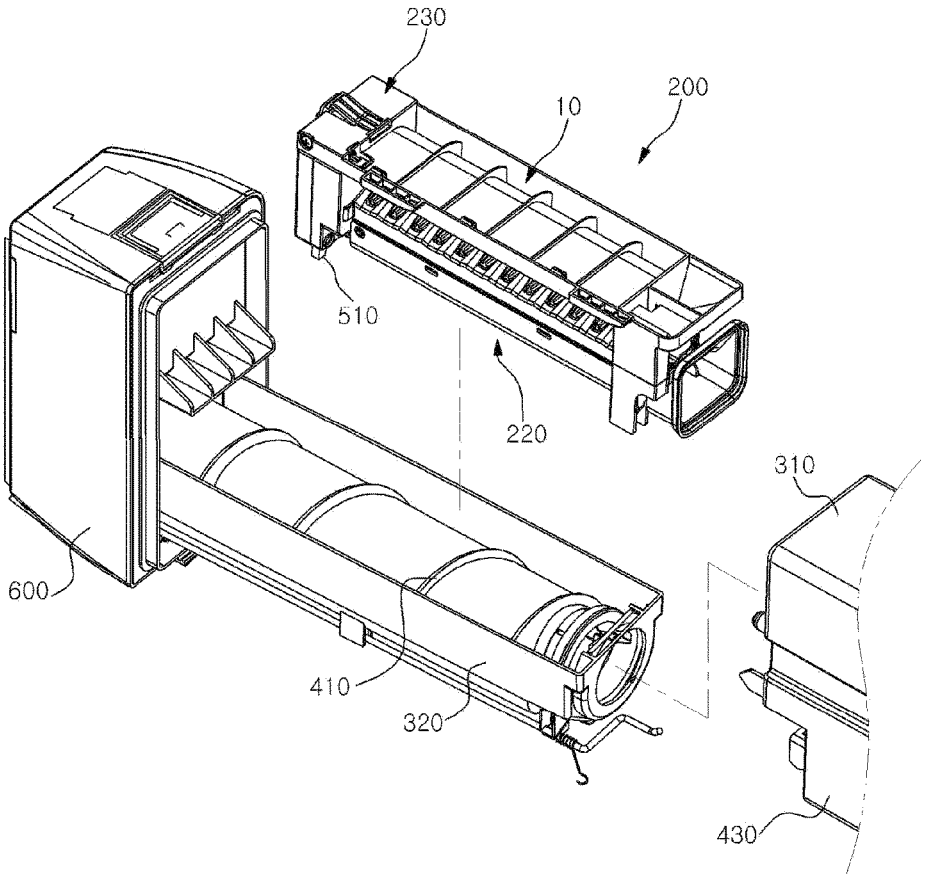
FIG. 3 is an exploded perspective view of an ice-making device provided in the refrigerator illustrated in FIG. 1.
Figure 4:
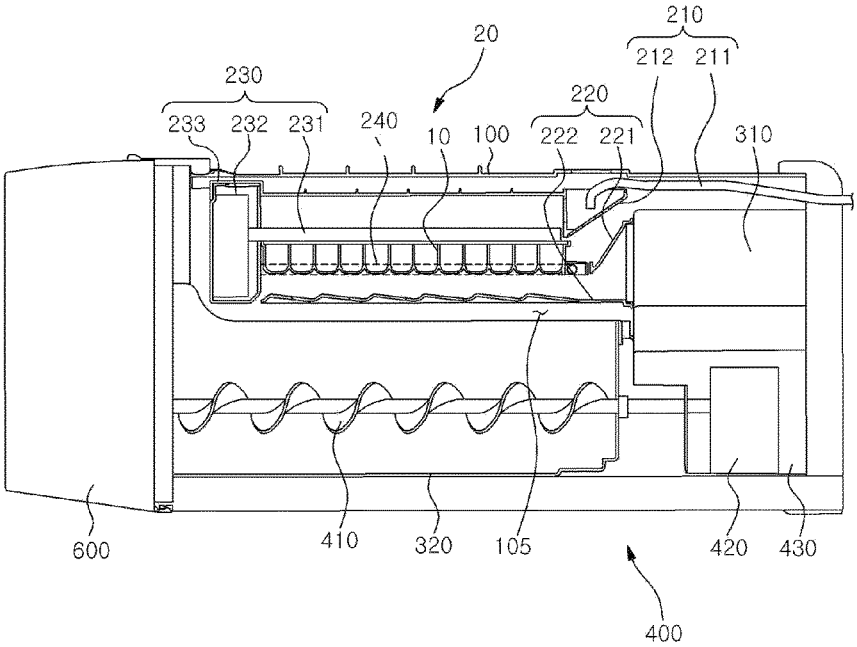
FIG. 4 is a side sectional view of the ice-making device illustrated in FIG. 3.

FIG. 3 is an exploded perspective view of an ice-making device provided in the refrigerator illustrated in FIG. 1, and FIG. 4 is a side sectional view of the ice-making device illustrated in FIG. 3.

Referring to FIGS. 3 and 4, the ice-making device 20, including the ice tray 10 according to one embodiment, is capable of uniformly supplying water to the ice-making spaces 13 of the ice tray 10. The ice-making device 20 may include a body or case 100, a cooling unit (not illustrated) configured to cool the interior of the case 100, an ice-making assembly 200 to which the ice tray 10 can be mounted, an ice bucket 320 in which pieces of ice produced in the ice tray 10 are stored, and a feeder assembly 400 configured to feed the pieces of ice from the ice bucket 320.

A cooling space 105 including ice tray 10 in which pieces of ice can be produced is formed within the case 100. The ice-making assembly 200 may be disposed at or within an upper portion of the cooling space 105.

The cooling unit is used to cool the cooling space 105. The cooling unit can cool the ice tray 10 by generating a cold air and supplying the generated cold air to the ice tray 10, or by bringing a cooling pipe (e.g., which can include a low-temperature refrigerant) into contact with the lower side of the ice tray 10. The cooling unit may include a compressor, a condenser, an expansion valve and an evaporator, which can form a cooling cycle. The cold air may be supplied by a blower or the like to the ice tray 10 via an ejection duct 310 and a cold air guide unit 220. In one embodiment, the cold air is supplied to the cooling space 105.

The ice-making assembly 200 may include an ice tray 10, a water supply unit 210 configured to supply water to the ice tray 10, a cold air guide unit 220 configured to guide the flow of the cold air so that the cold air supplied from the cooling unit moves along the lower surface of the ice tray 10, and a rotary unit 230 configured to drop the pieces of ice produced in the ice tray 10 into the ice bucket 320 located below the ice tray 10.

The water supply unit 210 is configured to supply water to the ice tray 10. The water supply unit 210 may include a feeder pipe 211 coupled to a water supply (e.g., supply tank, a tap water pipeline, etc.) and is configured to feed water to the ice-making assembly 200. Water supply unit 210 may also include a water supply guide member 212 configured to guide the water fed from the feeder pipe 211 to the ice tray 10.

Figure 5:
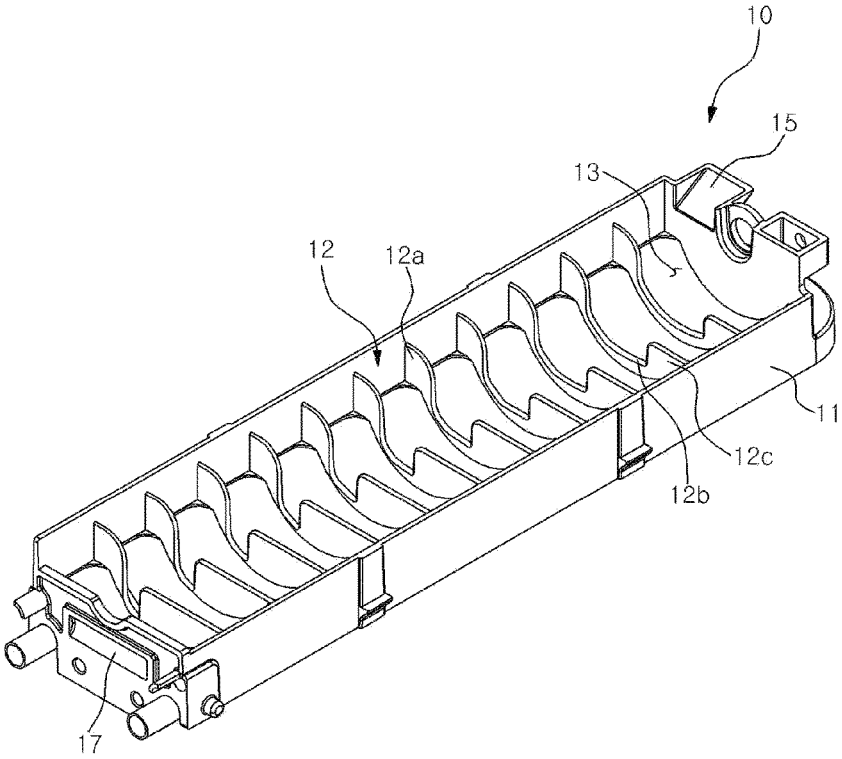
FIG. 5 is a perspective view illustrating an ice tray of an ice-making device for a refrigerator according to one embodiment of the present disclosure.
Figure 6:
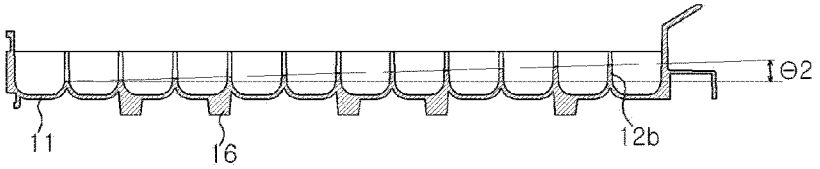
FIG. 6 is a view for explaining a structure by which water is supplied to the ice tray illustrated in FIG. 5.

FIG. 5 is a perspective view illustrating the ice tray of the ice-making device according to one embodiment of the present disclosure, and FIG. 6 is a view for explaining a structure by which water is supplied to the ice tray illustrated in FIG. 5.

Referring to FIGS. 5 and 6, the ice tray 10 includes ice-making spaces 13 in which water is phase-transformed into ice pieces. The shape of the ice pieces produced in the ice-making spaces 13 may correspond to the shape of the ice-making spaces 13. Specifically, the ice tray 10 includes a tray body 11 having a upper surface on which a plurality of ice-making spaces 13 for retaining water are formed, and a plurality of partition walls 12 extending upward from a bottom surface of the tray body 11, the partition walls 12 disposed between the ice-making spaces 13 to define the ice-making spaces 13.

Each of the partition walls 12 may include a first sidewall 12*a* extending by a predetermined length from one side surface of the tray body 11 toward each of the ice-making spaces 13, a second sidewall 12*c* extending by a predetermined length from the other side surface of the tray body 11 toward each of the ice-making spaces 13, the second sidewall 12*c* spaced apart from the first sidewall 12*a* by a predetermined distance, and a threshold 12*b* extending upward from a bottom surface of the tray body 11 to interconnect a lower portion of the first sidewall 12*a* and a lower portion of the second sidewall 12*c*.

The first sidewalls 12*a*, the second sidewalls 12*c* and the thresholds 12*b* may divide the tray body 11 into the ice-making spaces 13 and may define a plurality of water supply grooves which allow water to flow through the water supply grooves between the ice-making spaces 13. The tray body 11 may include a water supply port 15 which is an entrance through which the water supplied by the water supply unit 210 can be introduced. Accordingly, the water supplied to the ice tray 10 may fill the water supply grooves. As a result, the ice pieces produced in the ice tray 10 may include not only ice piece or cube portions corresponding to the ice-making spaces 13 but also connection portions (hereinafter referred to as "water supply groove bridges") having the shape of the water supply grooves which interconnect the ice-making spaces 13.

In one embodiment, the longitudinal end portion of the tray body 11 at which the water supply port 15 is provided is referred to as one end portion of the tray body 11. The longitudinal end portion of the tray body 11 opposite to one end portion will be referred to as the other end portion of the tray body 11. In one embodiment, when the ice tray 10 is disposed in the ice-making device 20, one end portion of the tray body 11 is arranged at the side of the rear end portion of the refrigerator 1.

In one exemplary implementation, the length of the first sidewalls 12*a* extending from one side surface of the tray body 11 may gradually increase from one end portion of the tray body 11 toward the other end portion. Similarly, the length of the second sidewalls 12*c* extending from the other side surface of the tray body 11 may gradually increase from one end portion of the tray body 11 toward the other end portion thereof. The length of the thresholds 12*b* extending upward from the bottom surface of the tray body 11 may gradually decrease from one end portion of the tray body 11 toward the other end portion. As illustrated in FIG. 6, an imaginary or reference line through upper end portions of the thresholds 12*b* extending upward from the bottom surface of the tray body 11 may make a second angle θ2 with respect to the bottom surface of the tray body 11. The second angle θ2 may be equal to or larger than the first angle θ1 at which the main body 2 of the refrigerator 1 is inclined.

The width of the water supply grooves defined by the first sidewalls 12*a*, the second sidewalls 12*c* and the thresholds 12*b* may grow smaller from one end portion of the tray body 11 toward the other end portion of the tray body 11. The depth of the water supply grooves defined by the first sidewalls 12*a*, the second sidewalls 12*c* and the thresholds 12*b* may grow larger from one end portion of the tray body 11 toward the other end portion of the tray body 11. In one exemplary implementation, the water supply grooves may be disposed along the longitudinal direction of the tray body 11 so as to have a substantially equal cross-sectional area.

The ice tray 10 may be made of a metal having high heat conductivity (e.g., aluminum, etc.). As the heat conductivity of the ice tray 10 grows higher, it becomes possible for the ice tray 10 to improve the heat exchange rate of water and the cold air. In one embodiment, the ice tray 10 may serve as a heat exchanger. Cooling ribs 16 for increasing the contact area of the ice tray 10 with the cold air may be provided on the lower surface of the ice tray 10.

A temperature sensor 17 capable of detecting the temperature of the ice tray 10 may be provided on the front surface of the ice tray 10. If the temperature of the ice tray 10 detected by the temperature sensor 17 falls within a predetermined range, a control unit (not illustrated) determines that ice pieces have been generated in the ice tray 10. If it is determined that ice pieces have been generated, the control unit may drive the rotary unit 230 to drop the ice pieces into the ice bucket 320.

The cold air guide unit 220 guides the cold air supplied from the cooling unit toward the lower side of the ice tray 10. The cold air guide unit 220 may be coupled to the ejection duct 310 which is a path through which the cold air is supplied from the cooling unit. The cold air guide unit 220 may include cold air guide members 221 and 222 which are coupled to at least one surface of the ejection duct 310. As illustrated in FIG. 4, the cold air guide unit 220 may include a first cold air guide member 221 extending from the upper surface of the ejection duct 310 and a second cold air guide member 222 extending from the lower surface of the ejection duct 310.

The cold air guided by the cold air guide members 221 and 222 can move toward the lower surface of the ice tray 10. As the cold air exchanges heat with the ice tray 10, the water retained in the ice tray 10 may be phase-transformed into ice pieces.

The rotary unit 230 may include a motor 232, a rotation shaft 231 coupled to the ice tray 10 and rotated by the motor 232, and a motor housing 233 configured to include the motor 232.

The ice pieces may be dropped by the rotary unit 230 into the ice bucket 320 disposed below the ice tray 10. Specifically, by virtue of the rotation of the rotation shaft 231, the ice tray 10 may be rotated so that the upper surface of the ice tray 10 faces toward the ice bucket 320. If the ice tray 10 is rotated at a specific angle or more, the ice tray 10 is twisted by an interference member (not illustrated). Due to this twisting action, the ice pieces accommodated in the ice tray 10 may be dropped into the ice bucket 320.

Alternatively, a plurality of ejectors (not illustrated) may be provided along the longitudinal direction of the rotation shaft 231. In this case, the ice tray 10 is not rotated and the ice pieces may be taken out from the ice tray 10 by the rotation of the ejectors of the rotation shaft 231.

Furthermore, an ice release heater 240 may be provided in the ice tray 10 so that the ice release heater 240 can heat the ice tray 10 during or prior to the rotation of the rotation shaft 231. By the heating action of the ice release heater 240, the surfaces of the ice pieces accommodated in the ice tray 10 may be melted and separated from the ice tray 10.

The feeder assembly 400 may include an auger 410 and an auger motor 420 which are configured to feed the ice pieces toward an ejection part 600. The auger 410 may be a rotating member having a screw or a spiral blade. The auger 410 is rotated by the auger motor 420. The auger 410 is disposed within the ice bucket 320. The ice pieces stacked in the ice bucket 320 may be inserted into the groove defined by the screw or the blade and may be fed toward the ejection part 600. The auger motor 420 may be accommodated within an auger motor housing 2 430.

The ejection part 600 may be coupled to a dispenser (not illustrated) provided in one of the refrigerating room doors 3. Depending on the user's choice, the ice pieces fed by the feeder assembly 400 may be dispensed to a user through the dispenser. While not illustrated in the drawings, a cutting member configured to cut the water supply groove bridges to obtain ice cubes having a predetermined size may be provided in the ejection part 600.

Next, descriptions will be made on the actions and effects of the ice tray of an ice-making device for a refrigerator, the method of manufacturing an ice tray of an ice-making device for a refrigerator and the refrigerator including an ice tray of an ice-making device according to one aspect of the present disclosure.

Figure 7:
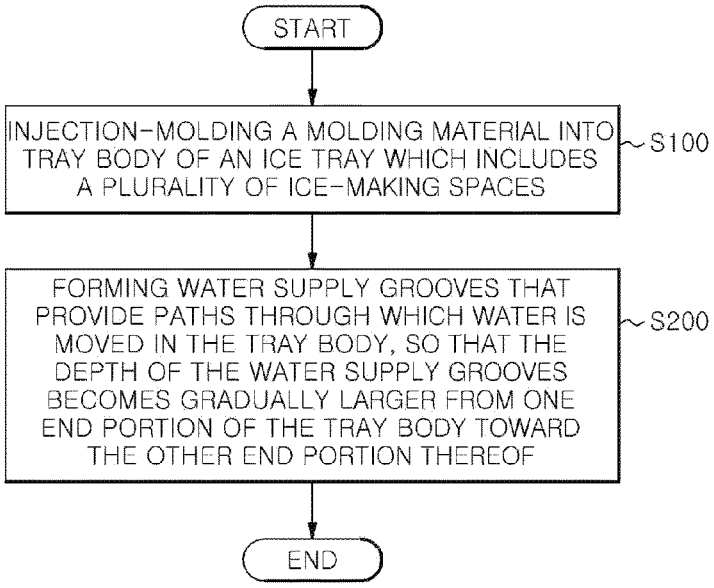
FIG. 7 is a flowchart illustrating a method of manufacturing an ice tray of an ice-making device for a refrigerator according to one embodiment of the present disclosure.

FIG. 7 is a flowchart illustrating the method of manufacturing an ice tray according to one embodiment of the present disclosure.

An ice tray molding material such as aluminum or the like may be injection-molded into the tray body 11 of the ice tray 10 having the ice-making spaces 13 (step S100). The water supply grooves may be formed in the tray body 11 of the ice tray 10 so that the depth of the water supply grooves becomes gradually larger from one end portion of the tray body 11 toward the other end portion thereof (step S200). In one exemplary illustration or drawing of the tray body 11, the water supply grooves may be formed so that an imaginary line or reference line through upper end portions of the thresholds 12*b* which define the water supply grooves may form a second angle θ2 with respect to the bottom surface of the tray body 11. That is to say, the water supply grooves may form a second angle θ2 with respect to the bottom surface of the tray body 11 and may grow deeper from one end portion of the tray body 11 toward the other end portion of the tray body 11. In one exemplary implementation, the water introduced into the tray body 11 through the water supply port 15 disposed in one end portion of the tray body 11 may smoothly move toward the other end portion of the tray body 11 along the water supply grooves which grow deeper from one end portion of the tray body 11 toward the other end portion.

The water supply grooves may be formed so that the depth thereof grows larger and the width thereof grows smaller from one end portion of the tray body 11 toward the other end portion. In one embodiment, the water supply grooves may have a substantially equal cross-sectional area. When the water filled in the water supply grooves is phase-transformed into ice, the portions of ice corresponding to the water supply grooves may have a substantially equal cross-sectional area and, therefore, may exhibit uniform strength against the cutting action substantially performed by the cutting member.

In the case where the ice tray 10 is provided in the refrigerator 1 obliquely installed at the first angle θ1 with respect to the floor surface G by the adjustable legs 6, the amounts of water supplied to the ice-making spaces 13 formed along the longitudinal direction of the ice tray 10 may become uniform, because the second angle θ2 is equal to or larger than the first angle θ1.

If the water supply is completed by the water supply unit 210, the cold air generated by the actions of the compressor, the condenser, the expansion valve and the evaporator is supplied to the cooling space 105 through the ejection duct 310. The supplied cold air may freeze the water contained in the ice tray 10 disposed within the cooling space 105.

The cold air moves along the lower surface of the ice tray 10 and exchanges heat with the lower surface of the ice tray 10, thereby freezing the water contained in the ice tray 10 into ice pieces. Thereafter, due to the rotation of the rotation shaft 231, the ice pieces may be dropped down and may be staked in the ice bucket 320.

As described above, in the ice tray 10 according to the present embodiment, the water supply grooves positioned farther from the water supply port are formed to have a gradually increasing depth so that a reference line or an imaginary connection line through upper end portions of the thresholds 12*b* which define the water supply grooves may make a predetermined angle with respect to the bottom surface of the tray body 11. This enables water to move smoothly through the water supply grooves. As a result, even when the ice tray 10 is installed in a refrigerator so that the other end portion of the ice tray 10 is higher than one end portion thereof with respect to the floor surface G, water may be uniformly supplied to the ice-making spaces 13.

Since water is uniformly supplied to the ice tray 10, the temperature sensor 17 may accurately detect the temperature of the ice tray 10 regardless of the installation position of the temperature sensor 17 in the ice tray 10. This makes it possible to accurately track the generation or formation of ice pieces.

Although exemplary embodiments according to the present disclosure have been described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example. The scope of the present disclosure is expressed by claims below, not the detailed description, and it should be construed that changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. An ice tray, comprising:

a tray body configured to provide ice-making spaces for retaining water; and a plurality of partition walls each including:

a first sidewall extending by a predetermined length from a first side surface of the tray body toward each of the ice-making spaces;

a second sidewall extending by a predetermined length from a second and opposite side surface of the tray body toward each of the ice-making spaces, the second sidewall spaced apart from the first sidewall by a predetermined distance; and a threshold extending upward from a bottom surface of the tray body to interconnect a lower portion of the first sidewall and a lower portion of the second sidewall, wherein the length of the thresholds extending upward from the bottom surface of the tray body gradually decreases from a first end portion of the tray body toward the other end portion a second and opposite end portion of the tray body.

2. The ice tray of claim 1, wherein the length of the first sidewalls extending from the first side surface of the tray body gradually increases from the first end portion of the tray body toward the second and opposite end portion of the tray body.

3. The ice tray of claim 1, wherein the length of the second sidewalls extending from the second and opposite side surface of the tray body gradually increases from the first end portion of the tray body toward the second and opposite end portion of the tray body.

4. The ice tray of claim 1, wherein the first sidewalls, the second sidewalls and the thresholds define a plurality of water supply grooves which allow water to flow between the ice-making spaces.

5. The ice tray of claim 4, wherein the depth of the water supply grooves grows larger from the first end portion of the tray body toward the second and opposite end portion of the tray body.

6. The ice tray of claim 4, wherein the width of the water supply grooves grows smaller from the first end portion of the tray body toward the second and opposite end portion of the tray body, and the water supply grooves are disposed along a longitudinal direction of the tray body so as to have a substantially equal cross-sectional area.

7. The ice tray of claim 1, wherein a reference line through upper end portions of the thresholds extending upward from the bottom surface of the tray body forms a second angle with respect to the bottom surface of the tray body.

8. A refrigerator, comprising:

a main body configured to constitute an outer shell and obliquely installed at a first angle with respect to a floor surface so that a second and opposite end portion of the main body is disposed higher than a first end portion of the main body;

an ice-making device configured to produce ice pieces, wherein the ice-making device includes an ice tray configured to include ice-making spaces capable of retaining water and phase-transformed into ice pieces, the ice tray includes:

a tray body configured to provide ice-making spaces for retaining water; and a plurality of partition walls each including:

a first sidewall extending by a predetermined length from a first side surface of the tray body toward each of the ice-making spaces;

a second sidewall extending by a predetermined length from a second and opposite side surface of the tray body toward each of the ice-making spaces, the second sidewall spaced apart from the first sidewall by a predetermined distance; and a threshold extending upward from a bottom surface of the tray body to interconnect a lower portion of the first sidewall and a lower portion of the second sidewall, wherein the length of the thresholds extending upward from the bottom surface of the tray body gradually decreases from a first end portion of the tray body toward a second and opposite end portion of the tray body.

9. The refrigerator of claim 8, wherein the length of the first sidewalls extending from the first side surface of the tray body gradually increases from the first end portion of the tray body toward the second and opposite end portion of the tray body.

10. The refrigerator of claim 8, wherein the length of the second sidewalls extending from the second and opposite side surface of the tray body gradually increases from the first end portion of the tray body toward the second and opposite end portion of the tray body.

11. The refrigerator of claim 8, wherein the first sidewalls, the second sidewalls and the thresholds define a plurality of water supply grooves which allow water to flow between the ice-making spaces.

12. The refrigerator of claim 11, wherein the depth of the water supply grooves grows larger from first end portion of the tray body toward second and opposite end portion of the tray body.

13. The refrigerator of claim 11, wherein the width of the water supply grooves grows smaller from first end portion of the tray body toward second and opposite end portion of the tray body, and the water supply grooves are disposed along a longitudinal direction of the tray body so as to have a substantially equal cross-sectional area.

14. The refrigerator of claim 11, wherein a reference line through upper end portions of the thresholds extending upward from the bottom surface of the tray body forms a second angle with respect to the bottom surface of the tray body.

15. A method of manufacturing an ice tray, comprising:

injection-molding a molding material into a tray body of an ice tray which includes a plurality of ice-making spaces; and forming water supply grooves that provide paths through which water is allowed to flow in the tray body, so that the depth of the water supply grooves becomes gradually larger from a first end portion of the tray body toward a second and opposite end portion of the tray body, wherein the forming water supply grooves includes forming a plurality of partition walls each including:

a first sidewall extending by a predetermined length from a first side surface of the tray body toward each of the ice-making spaces;

a second sidewall extending by a predetermined length from a second and opposite side surface of the tray body toward each of the ice-making spaces, the second sidewall spaced apart from the first sidewall by a predetermined distance; and a threshold extending upward from a bottom surface of the tray body to interconnect a lower portion of the first sidewall and a lower portion of the second sidewall, wherein the length of the thresholds extending upward from the bottom surface of the tray body gradually decreases from the first end portion of the tray body toward the second and opposite end portion of the tray body.

16. The method of claim 15, wherein the water supply grooves are formed so that the width of the water supply grooves grows smaller from first end portion of the tray body toward second and opposite end portion of the tray body.

17. The method of claim 16, wherein the water supply grooves are disposed along a longitudinal direction of the tray body so as to have a substantially equal cross-sectional area.

18. The method of claim 15, wherein the tray body is configured to include ice-making spaces for retaining water.

19. The method of claim 15, wherein the length of the first sidewalls extending from a first side surface of the tray body gradually increases from the first end portion of the tray body toward the second and opposite end portion of the tray body, and the length of the second sidewalls extending from a second and opposite side surface of the tray body gradually increases from the first end portion of the tray body toward the second and opposite end portion of the tray body.

* * * * *